US006880621B2

(12) United States Patent
Wang

(10) Patent No.: US 6,880,621 B2
(45) Date of Patent: Apr. 19, 2005

(54) RADIATOR

(76) Inventor: Dung-Mau Wang, Floor 5-1, No. 8, Section 3, Shuang-shi Road, Banchiau (TW), 220

( * ) Notice: Subject to any disclaimer, the term of this patent is extended or adjusted under 35 U.S.C. 154(b) by 110 days.

(21) Appl. No.: 10/366,333

(22) Filed: Feb. 14, 2003

(65) Prior Publication Data

US 2004/0159421 A1 Aug. 19, 2004

(51) Int. Cl.[7] ..... F28F 7/00

(52) U.S. Cl. ..... 165/80.3; 165/185; 361/704; 361/710; 174/16.3; 257/722

(58) Field of Search ..... 165/80.3, 185; 361/704, 710; 174/16.3; 257/722

(56) References Cited

U.S. PATENT DOCUMENTS 5,558,155 A * 9/1996 Ito ..... 165/80.3
6,401,810 B1 * 6/2002 Kuo et al. ..... 165/185
6,449,160 B1 * 9/2002 Tsai ..... 361/709
6,474,407 B1 * 11/2002 Chang et al. ..... 165/80.3
6,644,397 B1 * 11/2003 Shen ..... 165/185

* cited by examiner

*Primary Examiner*—Allen J. Flanigan

(57) ABSTRACT

The present invention provides a radiator that consists of a plurality of f ins, one side of each fin has at least one wing parallel relative to the side, the wing is disposed spaced from the fin. The wing has protruding parts disposed approximately perpendicularly to the wing. The fin has slots positioned relative to a corresponding protruding part. The protruding parts engage with the slots and the protruding parts are bent such that the fins are combined into a radiator. The radiator has following characteristics: simple structure, easily assembled, robust, easily formed, and material-saving.

4 Claims, 5 Drawing Sheets

RADIATOR

BACKGROUND OF THE INVENTION

1. Field of the Invention

The present invention provides a simple radiator structure that is easily assembled, robust, with easily formed components, presenting minimum material usage.

2. Description of Related Art

FIG. 1 shows a traditional computer processor radiator, the radiator group 60 comprise a plurality of fins 61 including attachment tabs 62 disposed perpendicularly on the upper and lower sides of the fin 61. The attachment tabs 62 all have a hook 621 and groove 622 for engaging an adjacent fin 61.

The prior art radiator has the following drawbacks:

The connecting of hook 621 with groove 622 is not stable enough, so they are easily separated from each other in the course of assembly or transport. The connection also distort easily, decreasing the effect of radiator. The prior art tabs are complicated and difficult to form, and wasteful of material.

SUMMARY OF THE INVENTION

The main object of the present invention is to provide a radiator that is simple in structure, easily assembled, robust, easily formed, and material-saving.

DETAILED DESCRIPTION OF THE PREFERRED EMBODIMENT

Objects of the present invention can be understood from the detailed structure which will be described in further detail with reference to the description. Of course, various parts or arrangement of parts of the present invention may be different. The embodiment selected will be described in detail in the description and the structure will be displayed in the accompanying drawings to disclose the summary of the present invention. What is shown and described is not meant to be limiting but merely illustrative.

Figure 1:
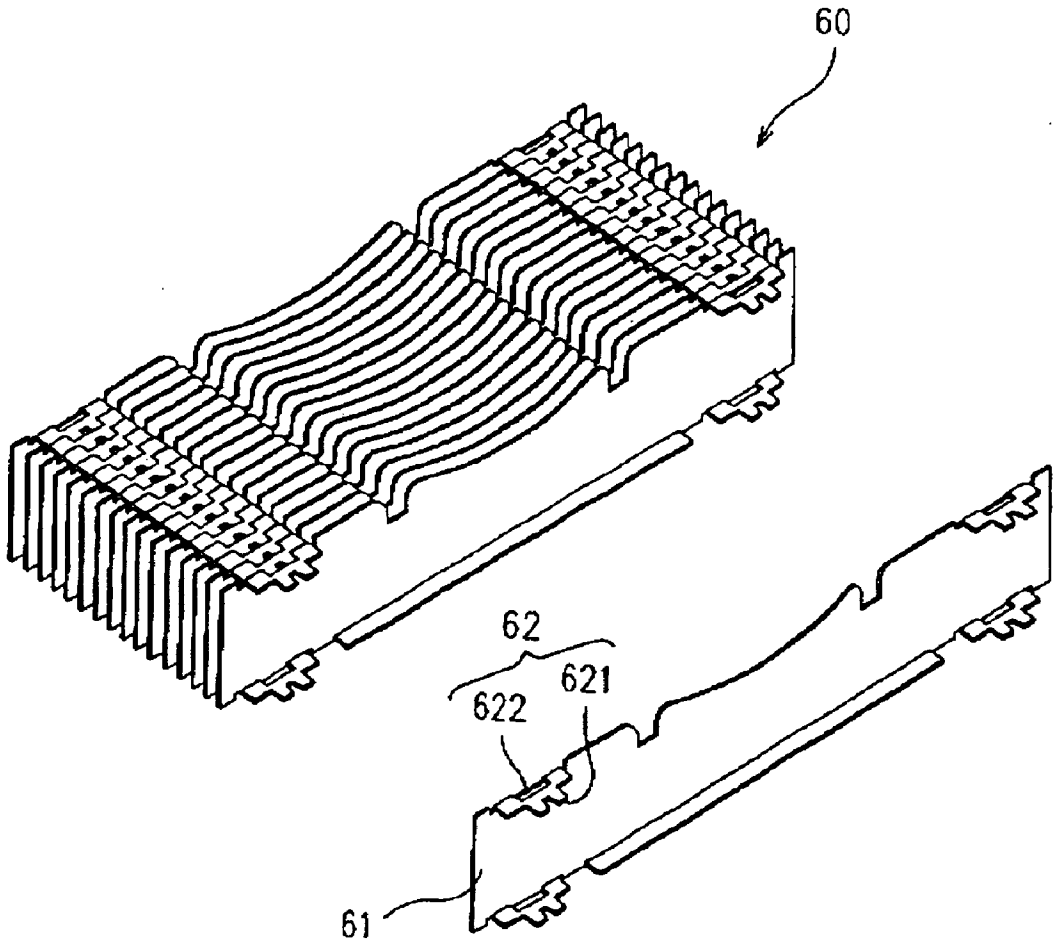
Fig 1 (PRIOR ART)
FIG. 1 is an exploded perspective view of a prior art radiator.
Figure 2:
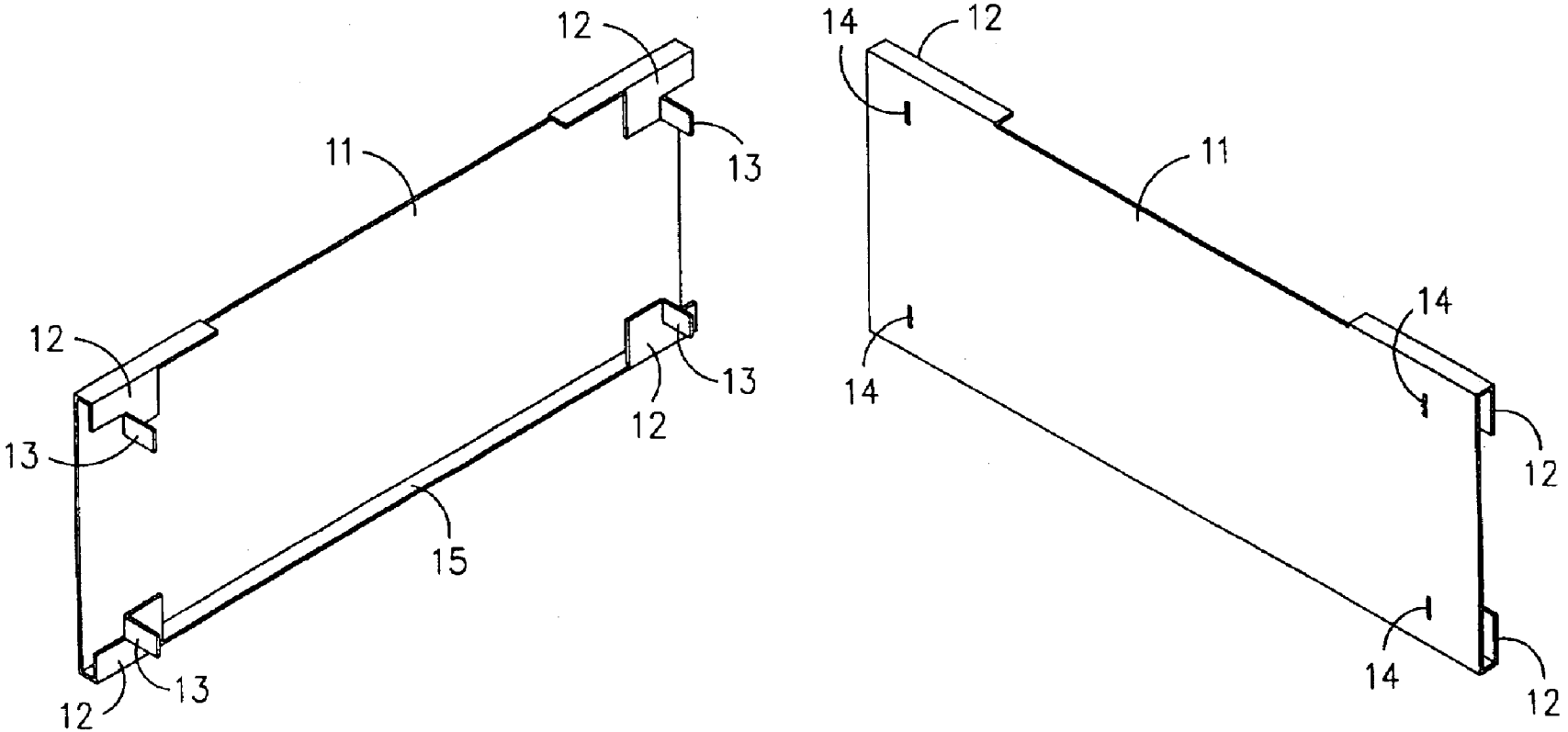
FIG. 2 is a perspective view of the present invention.
Figure 3:
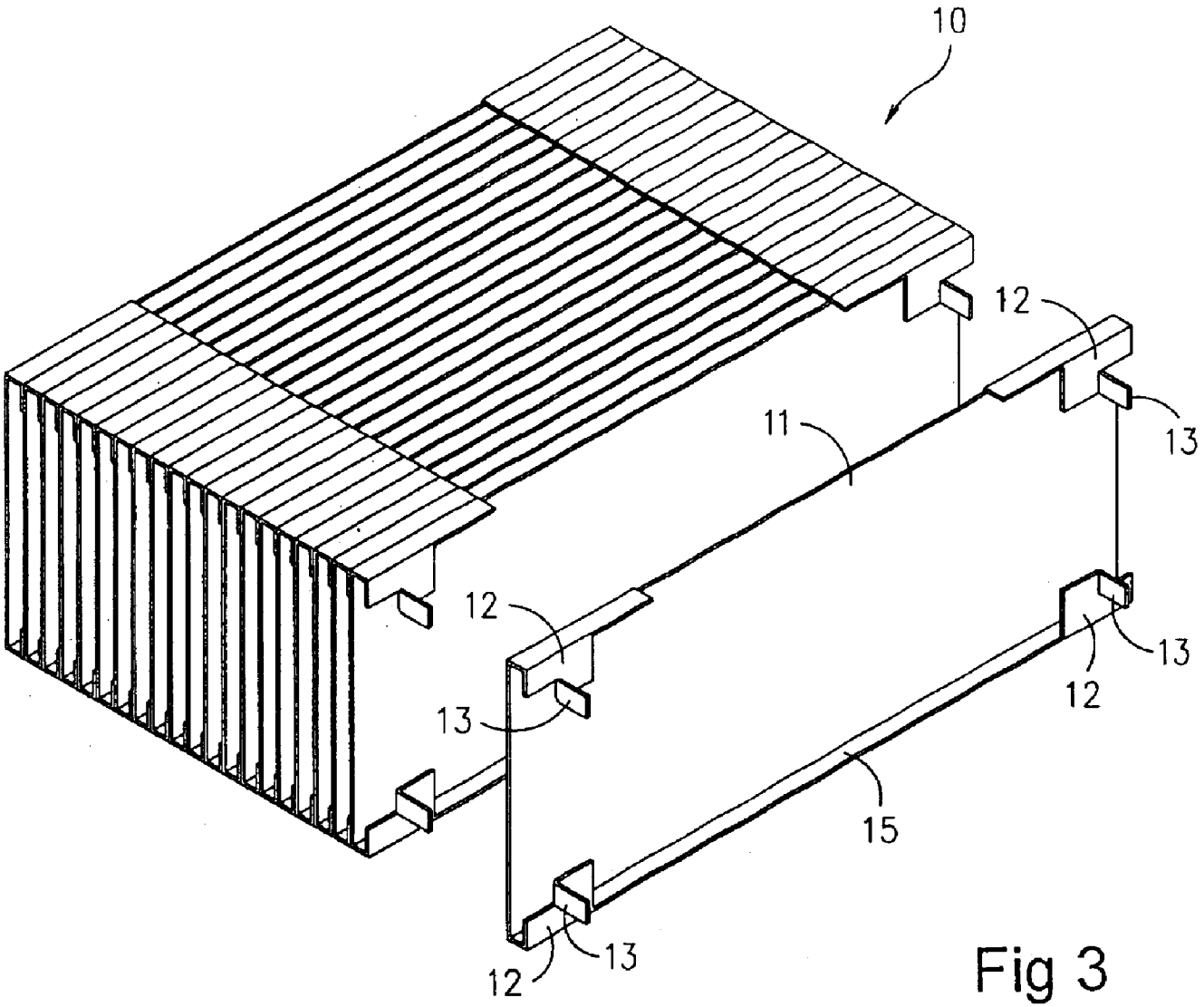
FIG. 3 is a combined perspective view of the present invention.
Figure 4A:
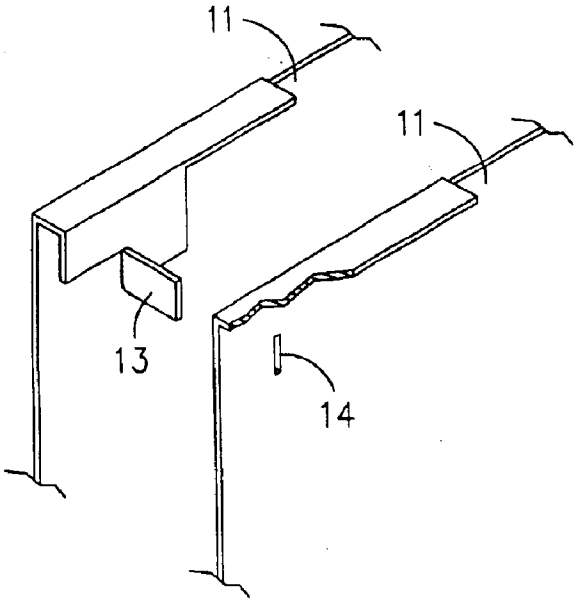
FIG. 4A to FIG. 4C are views of consecutive steps of the assembling process of the present invention.
Figure 4B:
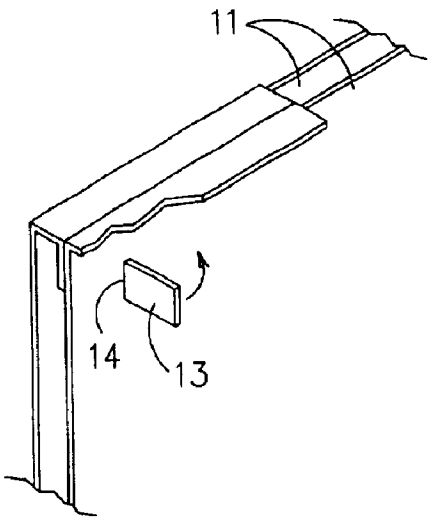
Figure 4C:
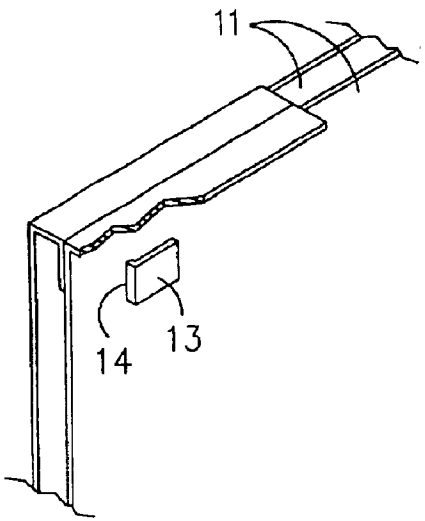

Referring to FIG. 2 and FIG. 3, the present invention provides a radiator 10 that comprises a plurality of fins 11. One side of the fins has at least one wing 12 parallel to said fins 11. As shown in drawing, the wings 12 are disposed on the symmetrical four corners of the fins 11; the wing 12 is spaced from the fins by a gap. The wing 12 has protruding parts 13 that extend approximately perpendicular to said wing 12. The protruding parts formed from pressing a molding from wing 12, so protruding parts 13 make the best use of material of wing 12 and will not waste material. The outline of protruding parts 13 may be tapered, with pointed corners, or any other shape besides the shape of a rectangle. The fins have slots 14 corresponding in position to protruding part 13. The fins 11 will be combined into a radiator 10 by engaging protruding parts 13 and slots 14 together. As shown in FIG. 4A to FIG. 4C, when protruding parts 13 of fin 11 are engaged in the slots 14 of adjacent fin 11, to strengthen the link between two fins 11, the protruding part 13 may be bent (shown in FIG. 4C) to engage slot 14. As far as the method of the bending protruding part 13, it may be accomplished by any known technique, and we will not describe it there. To increase the thermal contact area of radiator 10, the fin 11 may have connect part 15 disposed substantially perpendicular to said fin 11 between the side of bottom of fin 11 and wing 12. The connect part 15 will provide a heat absorbing contact surface after the fins 11 are engaged with each other.

Figure 5:
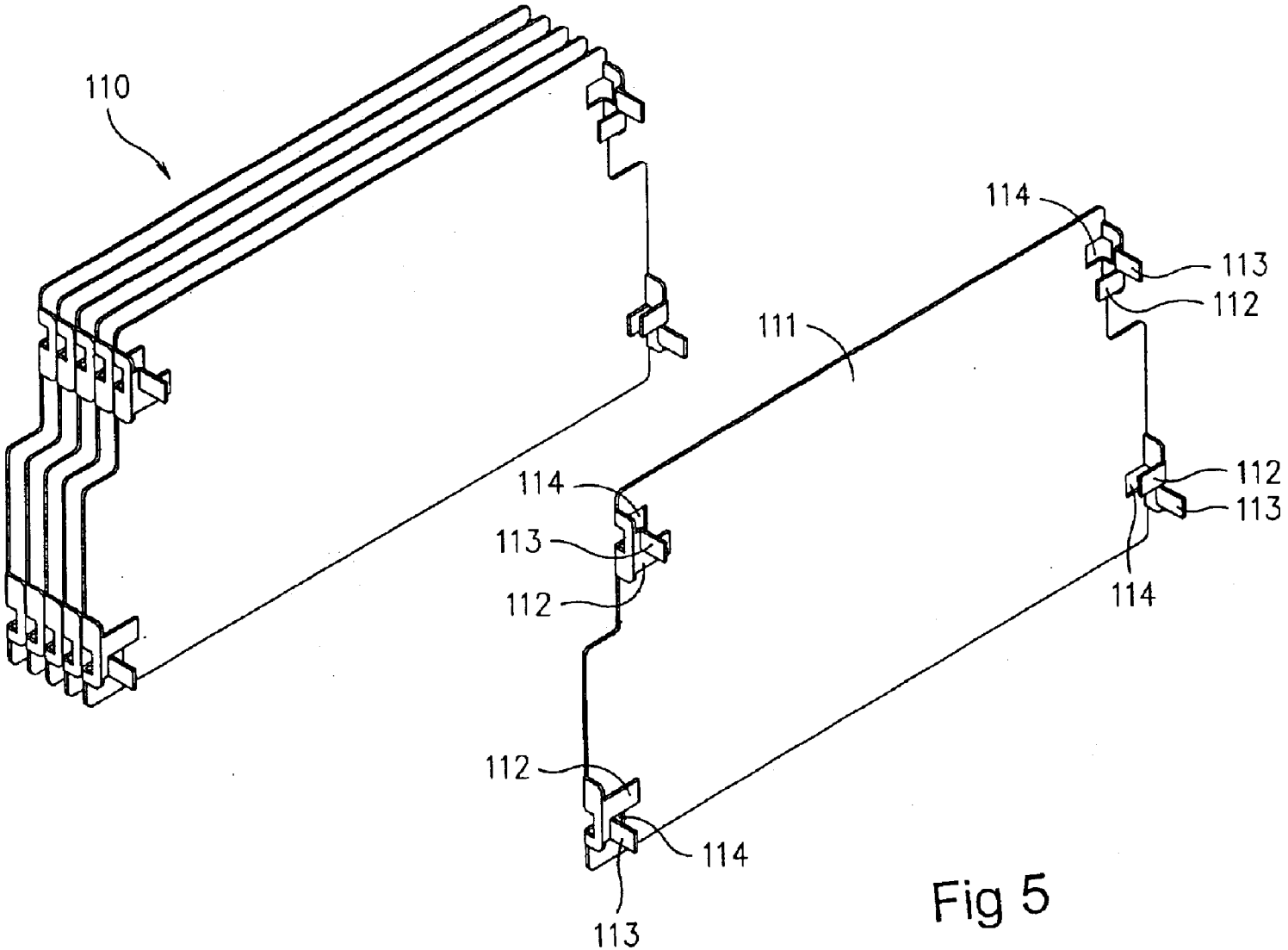
FIG. 5 is an isometric view of another embodiment of the present invention.

Referring to FIG. 5, a perspective view of another preferred embodiment of the present invention is shown. One side of the fin 111 has at least one wing 112 parallel to said fin 111; the two sides of said fin 111 are ladder-shaped; the wings 112 are disposed symmetrically on the four corners of said fins, and the wings 112 are spaced from said fin 111; said wing 112 has a protruding part 113 approximately perpendicular to said wing 112. The protruding parts 113 are formed from a pressing of a face of wing 112, so it make the best use of the material of wing 112 and will not waste material; the shape of protruding parts 113 may be tapered, with pointed corners or any other shape besides the shape of a rectangle. The fin 111 has slots 114 corresponding in position to said protruding parts 113. Fins 111 may be combined into a radiator 110 by the engagement of said protruding parts 113 with slots 114. Fin 111 may have a connecting part 15 on the bottom of said fin 111 (shown in FIG. 2) if needed.

The connecting part 15 will provide a heat absorbing contact surface after the fins 11 are engaged with each other.

The present invention as described above has the following advantages:

1. The connection of protruding part 13 with slot 14 is strong enough that will not break in the course of assembly or transport.
2. The connection of protruding part 13 with slot 14 is strong enough that is not distorted easily and has good radiation effect.
3. The structures of protruding part 13 and slot 14 are simple and easy to form.
4. The outlines of protruding part 13 and slot 14 are simple and material-saving.

The above description and corresponding drawings are embodiments of the present invention not intended to confine or limit the scope of the invention. Various modifications in structure and effect in the scope of the invention, the change of value and of equivalent members may be made without departing from the scope of the invention as defined by the appended claims.

What is claimed is:

1. A radiator comprising a plurality of stacked cooling fins; characterized in that each of the cooling fins has a surface, further having at upper and lower sides thereof a wing plate extending from said side and parallel to said surface, with a gap being constituted between the surface and the wing plate; and a protruding part extends perpendicularly outward from the wing plate; a slot is provided in the surface of the cooling fin at a location corresponding to that of projection part such that the cooling fins can be joined to each other by means of projection parts engaging with the slots of adjacent cooling fins.

2. The radiator of claim 1, wherein said projection part pierces said slot in the fin surface and is bent so as to engage the adjacent fin tightly.

3. The radiator as defined in claim 1, wherein the wing-plates are located near four corners of the cooling fin.

4. The radiator as defined in claims 1, 2, or 3, wherein said fins each have a connecting part extending substantially perpendicular to said fin surface disposed between wing plates at the bottom of said fin.

* * * * *